United States Patent [19]

Miller et al.

[11] Patent Number: 4,502,838

[45] Date of Patent: Mar. 5, 1985

[54] SOLID WHEEL TURBINE

[75] Inventors: Arthur J. Miller, North Huntingdon; Zaher M. Moussa, Greensburg, both of Pa.

[73] Assignee: Elliott Turbomachinery Co., Inc., Jeannette, Pa.

[21] Appl. No.: 390,604

[22] Filed: Jun. 21, 1982

[51] Int. Cl.[3] ..... F01D 1/02

[52] U.S. Cl. ..... 415/202; 415/56

[58] Field of Search ..... 415/81, 202, 212 R, 415/52, 56, 59, 62, 92, 117, 143, 199.6; 29/156.8 CF, 156.8 R; 408/1; 409/132

[56] References Cited

U.S. PATENT DOCUMENTS

| | | | |
|---|---|---|---|
| 812,795 | 2/1906 | Keller | 415/202 |
| 835,370 | 11/1906 | Smith | 415/52 |
| 845,059 | 2/1907 | Dake | 415/202 |
| 928,178 | 7/1909 | Burnfield | 415/202 |
| 1,038,972 | 9/1912 | Sanders | 415/56 |
| 1,625,433 | 4/1927 | Schmidt | 415/56 |
| 1,744,757 | 1/1930 | Ferguson | 292/167 |
| 2,480,807 | 8/1949 | De Vlieg | 90/13.9 |
| 2,633,776 | 4/1953 | Schenk | 90/11 |
| 3,147,551 | 9/1964 | Seegers | 32/27 |
| 3,471,125 | 10/1969 | Taubald et al. | 253/2 |
| 4,027,995 | 6/1977 | Berry | 415/202 |
| 4,421,454 | 12/1983 | Wosika | 415/202 |

*Primary Examiner*—Henry C. Yuen
*Assistant Examiner*—John Kwon
*Attorney, Agent, or Firm*—Robert P. Hayter

[57] ABSTRACT

The buckets of a turbine wheel are formed as a series of equally spaced, overlapping U-shaped passages in the rim of a wheel blank. In the machining operation, an island is left as the inner segment of the curved portion of the U and this is used in combination with labyrinth seals to provide a fluid seal between the inlet and the outlet portion of each bucket.

3 Claims, 8 Drawing Figures

SOLID WHEEL TURBINE

BACKGROUND OF THE INVENTION

The buckets or blades of turbines are subject to wear or erosion due to a number of factors. In a steam turbine prime mover, for example, the kinetic energy that is absorbed from the steam by the moving blades or buckets and delivered as shaft work to the device being driven results from the expansion of the steam into the heat of vaporization region resulting in a lowering in the quality of the steam. As the moisture content rises with the lowering of steam quality, the buckets or blades become more susceptible to erosion. Although wet steam is generally associated with the last stages of a condensing steam turbine, energy recovery from process steam and the advent of geothermal power, for example, have resulted in the initial supplying of wet steam, e.g. 20–30% quality for geothermal steam and 80% quality for oil well steam injection. In addition to the presence of water droplets, blade erosion is also a function of the velocity and impingement angle of the moisture particles. The presence of particulates in gases has a similar effect to the presence of water droplets. One solution to blade erosion is the use of replaceable blades. Additionally, for low horsepower, dependent upon steam inlet and exit conditions, conventional axial turbines are inefficient due to partial admission operation.

SUMMARY OF THE INVENTION

The present invention is directed to a turbine of solid wheel construction which is capable of very high tip speeds depending upon the type of design and the material used. This turbine is more efficient than a conventional axial flow turbine and is at least as efficient as a radial inflow turbine in the overall sense since it has a much lower RPM and therefore smaller mechanical losses. The buckets are machined into the outer diameter of the wheel. The nozzle ring construction is of the radial inflow type with converging or expanding nozzles and low incidence angles for maximum performance. Because of the bucket geometry and the tangential inflow from the nozzles, moisture droplets or solid particulates moving slower than the gas flow will impinge upon the buckets at low angles and low relative velocities greatly reducing erosion and minimizing braking losses. The inlet and exhaust casings are simply constructed to enable partial to full admission of motive fluid at very high pressures. Since the turbine wheel has buckets machined directly into it, bucket failures are essentially impossible. Furthermore, because of the inherent geometrical configuration of the buckets in relation to the disk, disk/blade induced vibration is virtually eliminated. Integral rotor or through bolt construction may be used. With this rugged construction, the present invention is suitable for a wide range of gases, either superheated or saturated. By using a gear unit, any output shaft speed is obtainable at optimum turbine efficiency.

It is an object of this invention to provide a solid wheel turbine and the method of making the same.

It is a further object of this invention to provide a 2-stage solid wheel turbine and the method of making the same.

It is an additional object of this invention to provide a turbine wheel having high moisture and particulate erosion resistance, low windage and low thrust capabilities.

It is another object of this invention to provide a radial admission turbine which is more efficient than a conventional axial flow turbine and at least as efficient overall as a radial inflow turbine at low horsepower.

It is a further object of this invention to provide a turbine suitable for use with wet steam and dirty gases. These objects, and others as will become apparent hereinafter, are accomplished by the present invention.

Basically, a plurality of uniformly spaced buckets are formed in the rim of a solid wheel. Each of the buckets has an overlapping relationship with the adjacent buckets in the machining operation such that the wall of each bucket is essentially a portion of the side of a cylinder and defines an essentially semicircular bight with straight extensions or legs on both sides and an island at the center of the cylinder. Motive fluid is supplied in a generally tangential direction with respect to the rim of the wheel from points axially spaced from the center of the buckets such that flow is between one side of the wall defining the bight and the island and the fluid is turned through approximately 180° with a transfer of kinetic energy to the wheel and exits from the bucket between the other side of the wall defining the bight and the island.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

For purposes of understanding, only, the invention will be described specifically as employed in an overhanging 2-stage turbine but would also be applicable to a simply supported shaft, for example, as in the conventional axial type. Additionally, the specific choice of materials would be a function of the design pressures, temperatures, and other aspects of the operating condition.

Figure 1:
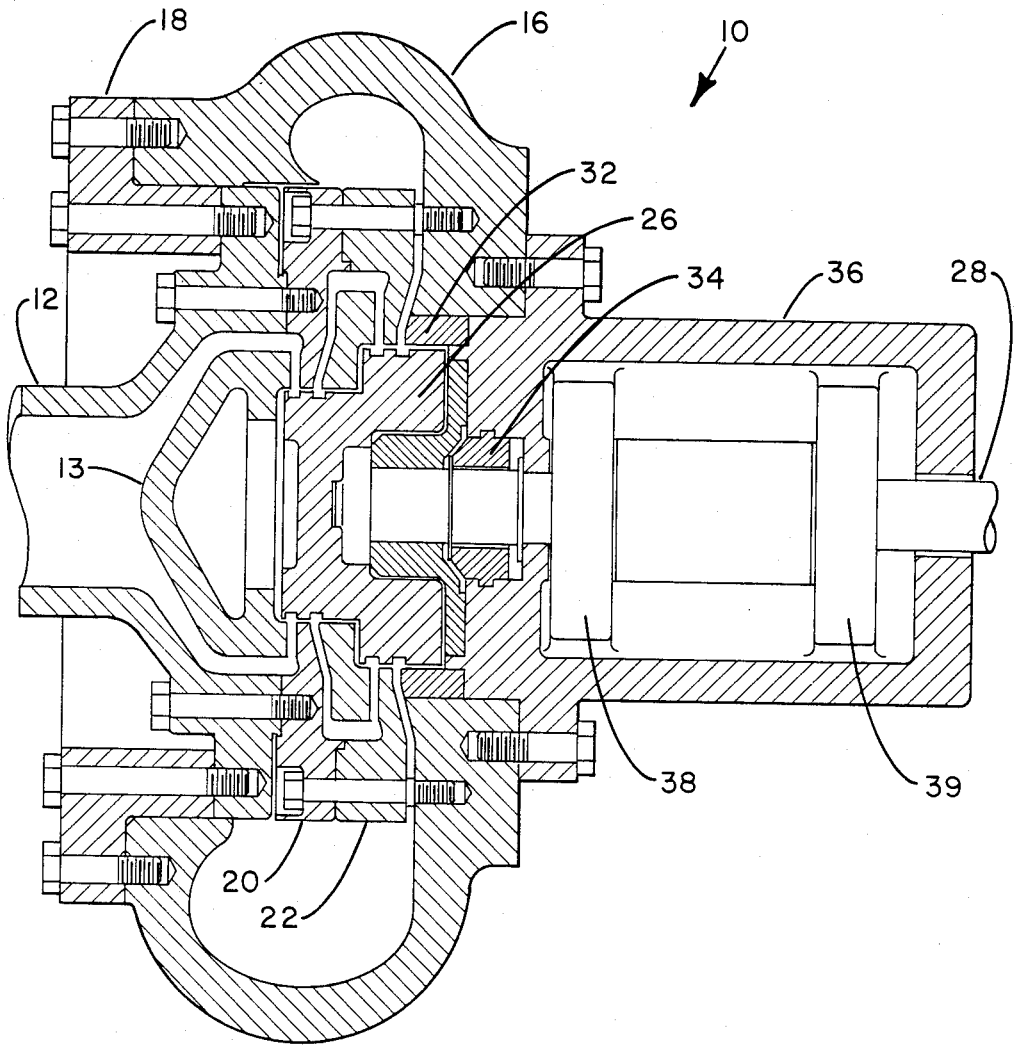
FIG. 1 is a sectional view of a 2-stage turbine employing the solid wheel of the present invention.
Figure 2:
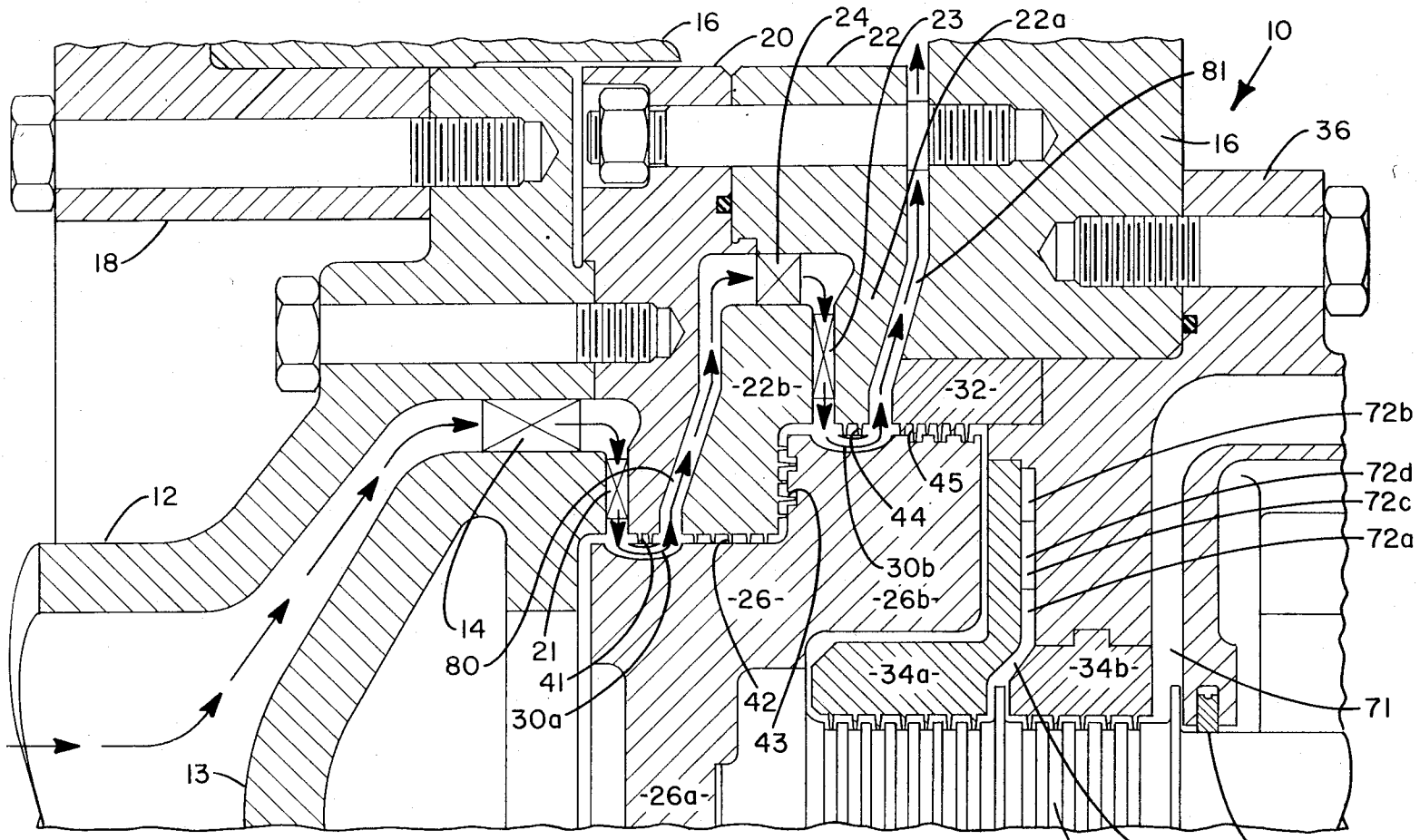
FIG. 2 is partially sectioned view of a portion of the turbine of FIG. 1.

In FIGS. 1 and 2, the numeral 10 generally designates a 2-stage solid wheel turbine including axial inlet casing 12, exhaust volute casing 16, volute cover 18, first stage nozzle ring 20, second stage nozzle assembly 22, 2-stage solid turbine wheel or rotor 26, shaft 28, balance piston seal ring 32, shaft seal ring 34, bearing housing 36 and bearings 38 and 39. Labyrinth seal 41 provides a seal between wheel 26 and nozzle ring 20. Labyrinth seals 42, 43 and 44 provide a seal between wheel 26 and nozzle assembly 22. Labyrinth seal 45 provides a seal between wheel 26 and balance piston seal ring 32.

Inlet casing 12 is, preferably, a one piece casting, such as chrome stainless steel, and consists of a short, flanged axial inlet pipe adapted to be connected to a source of steam, an inlet cone containing nose cone 13 and inlet guide vanes 14. Inlet casing 12 serves as the connection between the steam source and the turbine 10 and provides support to the nozzle structures 20 and 22 and is in turn supported by exhaust volute casing 16 through volute cover 18. Volute cover 18 is shaped as a one piece flanged shell and serves to seal leakage from/to volute casing 16 and to support inlet casing 12 and nozzle structures 20 and 22.

Exhaust volute casing 16 is, preferably, a scroll or a torus type volute with a tangential discharge and is suitably made as a one piece carbon steel casting. Volute casing 16 serves as a collector for the exhaust steam as well as containing and housing the other turbine components. The nozzle structures 20 and 22 are, preferably, stainless steel. Nozzle ring 20 is of one piece, solid ring type construction while nozzle assembly 22 is of two piece construction made up of members 22*a* and *b*. Nozzle blades 21 and 23 are milled integral into the diaphragms defined by members 20 and 22*a*. The angles and sizes of the nozzle blades 21 and 23 depend upon the design load. The interstage labyrinth seals 41, 42, 43, and 44 carried by the nozzle structures 20 and 22 are also, preferably, stainless steel. More specifically, first stage nozzle ring 20 is of a type providing a generally tangential discharge with respect to the first stage 26*a* of turbine wheel 26. The nozzle blades 21 milled into the ring type steel plate or diaphragm are of the profile-type blades. On the inner rim of the nozzle ring 20, labyrinth seal 41 serves to isolate the bucket inlet from its outlet. Nozzle ring 20 is securely attached to the inlet casing 12 so that there is no clearance over the free end of the nozzle blades. In a 2-stage turbine, as illustrated, first stage nozzle ring 20 is attached to the second stage nozzle assembly 22 while it is attached directly to the exhaust volute casing 16 for a single stage turbine. The second stage nozzle assembly 22 consists of essentially two parts. The first part, 22*a*, is a nozzle ring member similar to nozzle ring 20 and the second part, 22*b*, is a diaphragm-like disk member containing labyrinth seal 42 on its inner rim and labyrinth seal 43 on its side facing the second stage, 26*b*, of wheel 26. On the outer edge of the diaphragm 22*b*, there are axial-type guide vanes 24 which may be machined directly onto member 22*b*, they may be standard stock welded onto member 22*b*, or they can be cast as an integral part with member 22*b*, if member 22*b* is cast. The axial guide vanes 24 serve two purposes: the first is to impart tangential momentum to the steam flow; and, the second purpose is to provide mechanical guidance and support to the member 22*b* in the radial direction. Alternatively, the axial guide vanes 24 can be replaced by radial reversing vanes or blades (not illustrated) at the outer diameter of the diaphragm opposite the nozzle ring 20. Members 22*a* and *b* are assembled together to form an integral second stage nozzle assembly 22. Assembly can be by using one stud (not illustrated) through each blade 23 of member 22*a*, at the point of maximum thickness, which may be followed by brazing to enhance the strength of the overall assembly. Both the first stage nozzle ring 20 and the second stage nozzle assembly 22 are supported inside exhaust volute casing 16 in the illustrated embodiment.

Balance piston seal ring 32 is of a tubular ring form with a diametral split and is used only with multistage machines. Labryinth seal 45 is located on the inner face of seal ring 32. Seal ring 32 is bolted to the bearing housing 36 through its thickness. Shaft seal ring 34 is illustrated as a stepped labyrinth seal with two intermediate pressure leak-off ports 70 and 71 which break down the stream pressure to slightly below or slightly above atmospheric, depending upon operating conditions and design specifications, and form a 2-stage seal. The high pressure stage, 34*a*, is a flanged-sleeve type with a diametral split. The inner face of the flange is machined so that when it is fastened to the bearing housing 36 it provides two annular collection chambers 72*a* and *b* connected by radial passages 72*c* between islands 72*d*. Through these islands 72*d*, the first or high pressure stage 34*a* of seal ring 34 is bolted to bearing housing 36. The low pressure seal, 34*b*, is a split sleeve type supported by the bearing housing 36 through a tongue-and-groove connection.

The bearing housing 36 is suitably made as a horizontally split grey iron casting. Bearings 38 and 39 are journal bearings of the tilting pad type. The journal loads are light and surface speed is moderate. Also, rotor thrust loads are balanced so that residual thrust loads are absorbed by fixed pad type thrust bearings which are integral with the journal assemblies.

The rotor 26, as illustrated, is of an over hung and flexible shaft design and may or may not be integral with shaft 28 depending upon the design operating conditions. For single stage machines, it should always be possible to use the wheel and shaft as an integral part. However, for a 2-stage machine, this would depend on the back pressure on the back face of the second stage rotor 26*b*. The back pressure, among other factors determines the number of seal teeth required. The rotor dynamics determine how much overhang is allowed. These two considerations then determine what kind of shaft/disk arrangement is to be adopted. For 2-stage machines, as illustrated, the first and second stage rotors, 26*a* and *b*, respectively, are integral. The method selected for coupling wheel 26 and shaft 28 would depend upon the rotational speed of the wheel 26 e.g. simple flanged shaft/disk bolted together or a polygon fit. As will be described in greater detail below, aerodynamic passages or buckets 30*a* and 30*b* are milled into the disks of the first and second stage rotors, 26*a* and *b*, respectively. Wheel 26 is suitably made as a stainless steel forging and shaft 28 is suitable made of chrome-molybdenum steel. The back side of the wheel 26 facing the bearing housing or gear box 36 is used as a balance piston only in the case of a 2-stage machine.

As illustrated, the labyrinth seals 41, 42, and 44 are straight through with no split and seal 43 is stepped with no split. Seal 45 may or may not be a stepped type. If it is a stepped type, as illustrated, it must be split unless the steps are of ever increasing/decreasing diameter so as to permit transverse movement for assembly. The labyrinth seals serve to control leakage of the high pressure thrust balancing steam which is injected into the back side of the wheel 26. Carbon seal 46 serves to keep moisture out and oil in the bearing housing 36. Carbon seal 46 could be replaced by a slightly pressurized air source leaking off into bearing housing 36 and the turbine via labyrinth seals, as is conventional.

Figure 3:
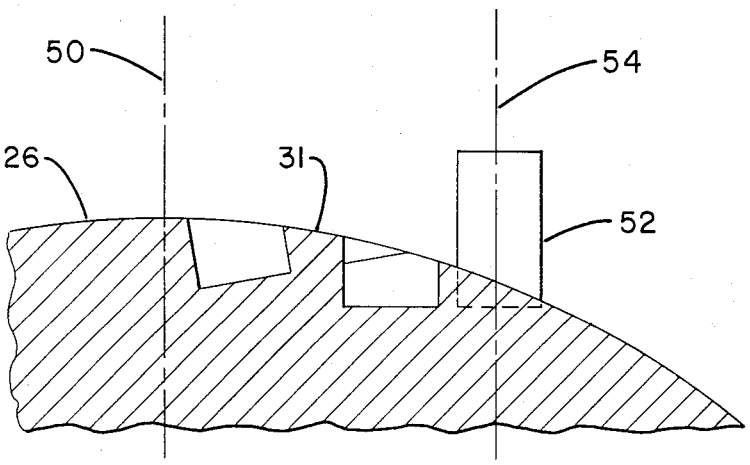
FIG. 3 is a side sectional view of the bucket forming operation.
Figure 4:
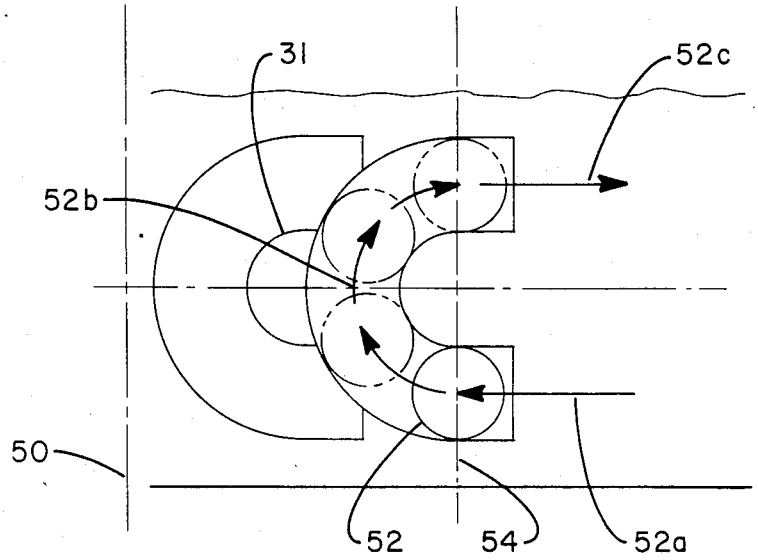
FIG. 4 is a top view of the bucket forming operation.
Figure 5:
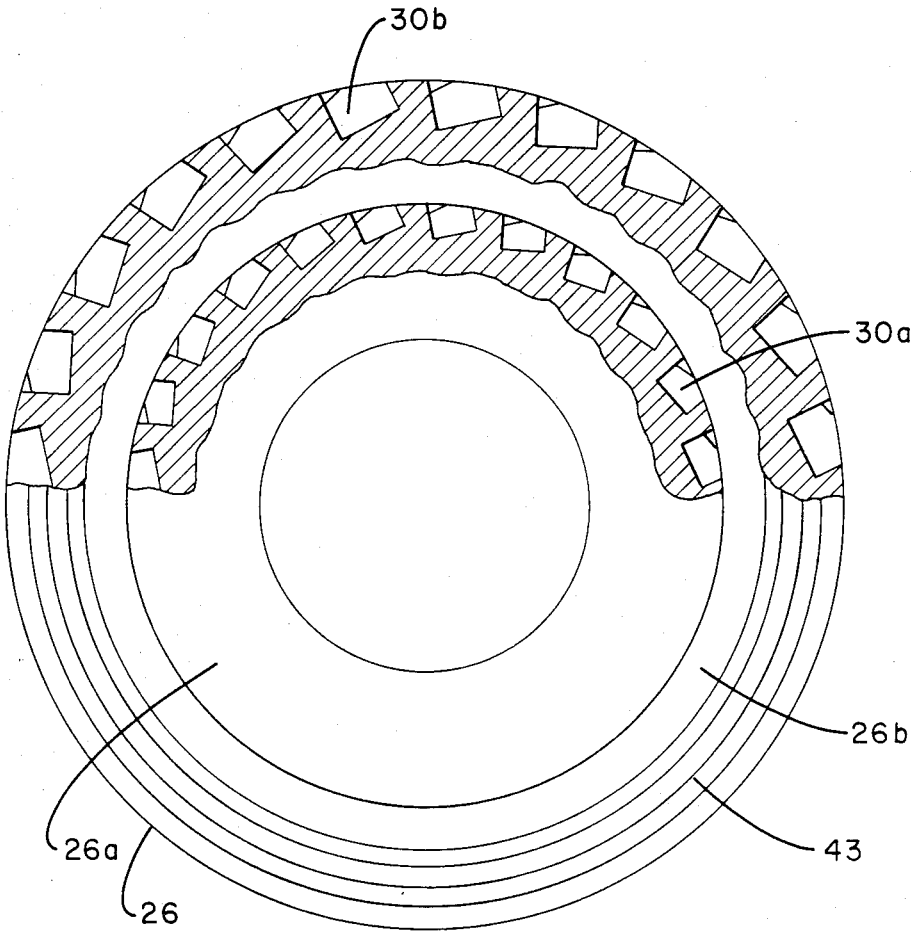
FIG. 5 is a partially sectioned view of a 2-stage solid wheel.

The machining process for the forming of aerodynamic passages or buckets 30, whether as first stage buckets 30*a* or second stage buckets 30*b*, is essentially the same and the process will be described in terms of generic buckets 30. Referring now to FIGS. 3 and 4, for machining, the rotor or wheel 26 is supported on an indexed table (not illustrated) whose axis is perpendicular to the axis 54 of end mill cutter 52. The end mill cutter axis 54 has two degrees of motion freedom relative to the vertical plane 50 which runs through the axis of wheel 26. The two degrees of freedom of axis 54 are numerically controlled such that, as best shown in FIG. 4, the rotating end mill cutter 52 moves perpendicular to plane 50 along the path indicated by arrow 52*a*, then moves in a semicircular path indicated by arrow 52*b* followed by movement perpendicular to plane 50 along the path indicated by arrow 52*c*. In machining the bucket 30, the end mill cutter leaves an island portion 31 whose significance will become apparent hereinafter. Upon the completion of the machining of one bucket 30, the wheel is rotated a calculated angular distance determined by the particular design and the machining operation is repeated. This process is repeated until the entire rim of the wheel 26 is machined to produce a series of equally spaced, overlapping buckets 30. For a 2-stage rotor this process would be repeated for each stage although the cutter settings may be changed. A machined 2-stage rotor 26 is shown in FIG. 5. To machine different buckets with different angles to obtain different aerodynamic effects, all that is needed is to change the off-set between the cutter axis 54 and the plane 50 and the vertical height of the cutter 52 relative to the indexed table. For example, the island 31 need not be in the center although it will generally take two cuts by cutter 52 if a part of the cut is to be wider than the diameter of cutter 52.

Figure 6:
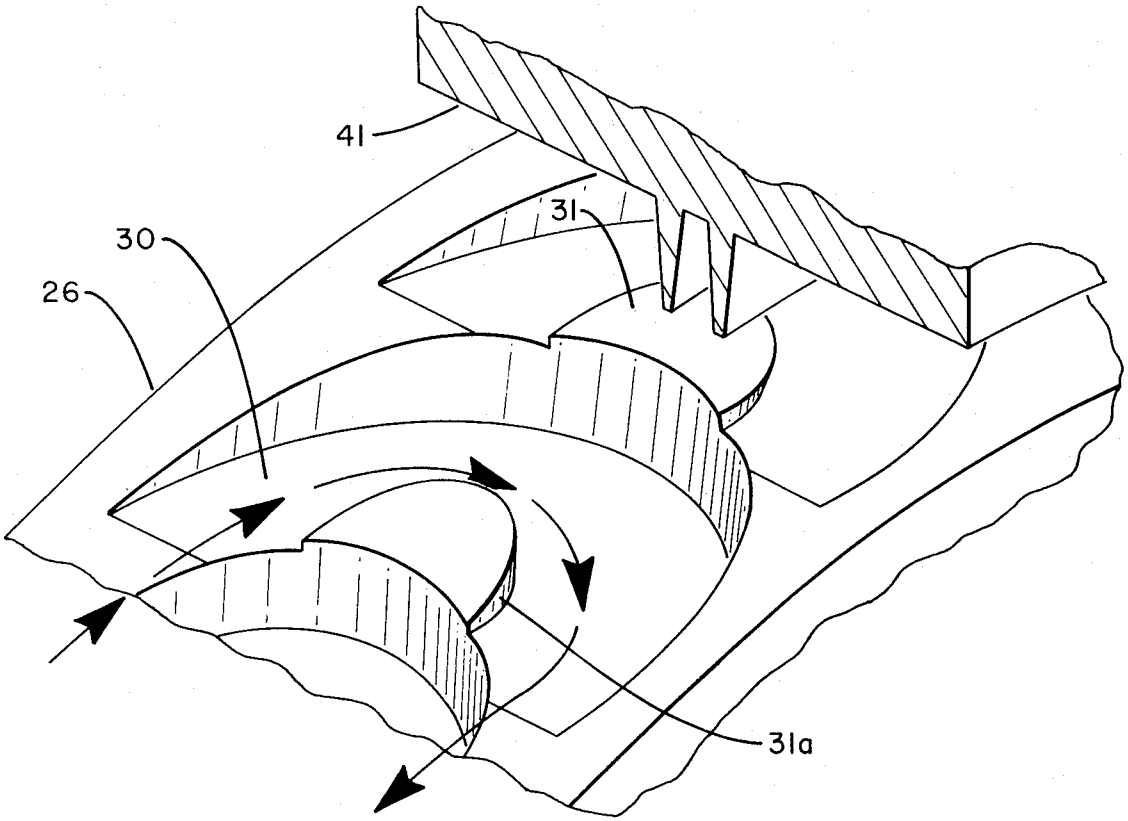
FIG. 6 is an isometric view of a bucket and its associated seal.

The shaping of the rotor buckets 30, as proposed, and sealing between the inlet and exit of the rotor 26 by means of labyrinth seals 41 and 44 for first stage 26*a* and second stage 26*b*, respectively, achieves a number of results. The inclusion of the small metal island 31 results in a guided 180° passage. This guided passage augments the work done by a given rotor for the same nozzle exit conditions and tip speed in three ways. First, the including of the bucket inner island 31 is, in effect, the creation of suction surface 31*a* (similar to that of an ordinary 180° bend) which transfers more power from the flowing stream to the shaft. Without the inclusion of island 31, the fluid stream at the inner passage radius would be free, resulting in eddies which would dissipate potential energy which could be recovered by the inclusion of the island 31. Second, as best seen in FIG. 6, because of the sealing effect rendered by labyrinth seals 41 and 44 between the inlet and exit of the buckets 30, in the first and second stage, respectively, and for reason of the conservation of mass and energy, energy losses are reflected as a static pressure drop across each stage of the rotor 26. Thus, some positive degree of reaction (estimated to be on the order of 5 to 10%) results, enhancing further the work done by a given rotor. Depending upon the design condition, the degree of reaction can be changed by changing the passage shape without changing the machining method e.g. a flow path that converges in going from the inlet to the outlet of the bucket results in a high degree reaction bucket. Such a bucket would result from, effectively, moving the island towards the outlet side to create the converging flow path. This would, however, generally require two cuts but the method of machining would remain basically the same and the necessary changes are known to those skilled in the art. Third, the elimination of one solid surface bounding the flow through the buckets 30 results in reducing profile losses due to reducing the skin friction experienced by the fluid flowing through the buckets 30. This, in effect, is the reduction of the hydraulic area available for viscous dissipation. This should also result in the reduction of secondary losses by substantially eliminating one of the agents causing such secondary losses, i.e. the solid bounding surface. Additionally, imparting some reaction to the rotor 26 would supress or help in reducing the bucket losses in a fashion similar to what occurs in reaction axial turbines and accelerating bends.

Figure 7:
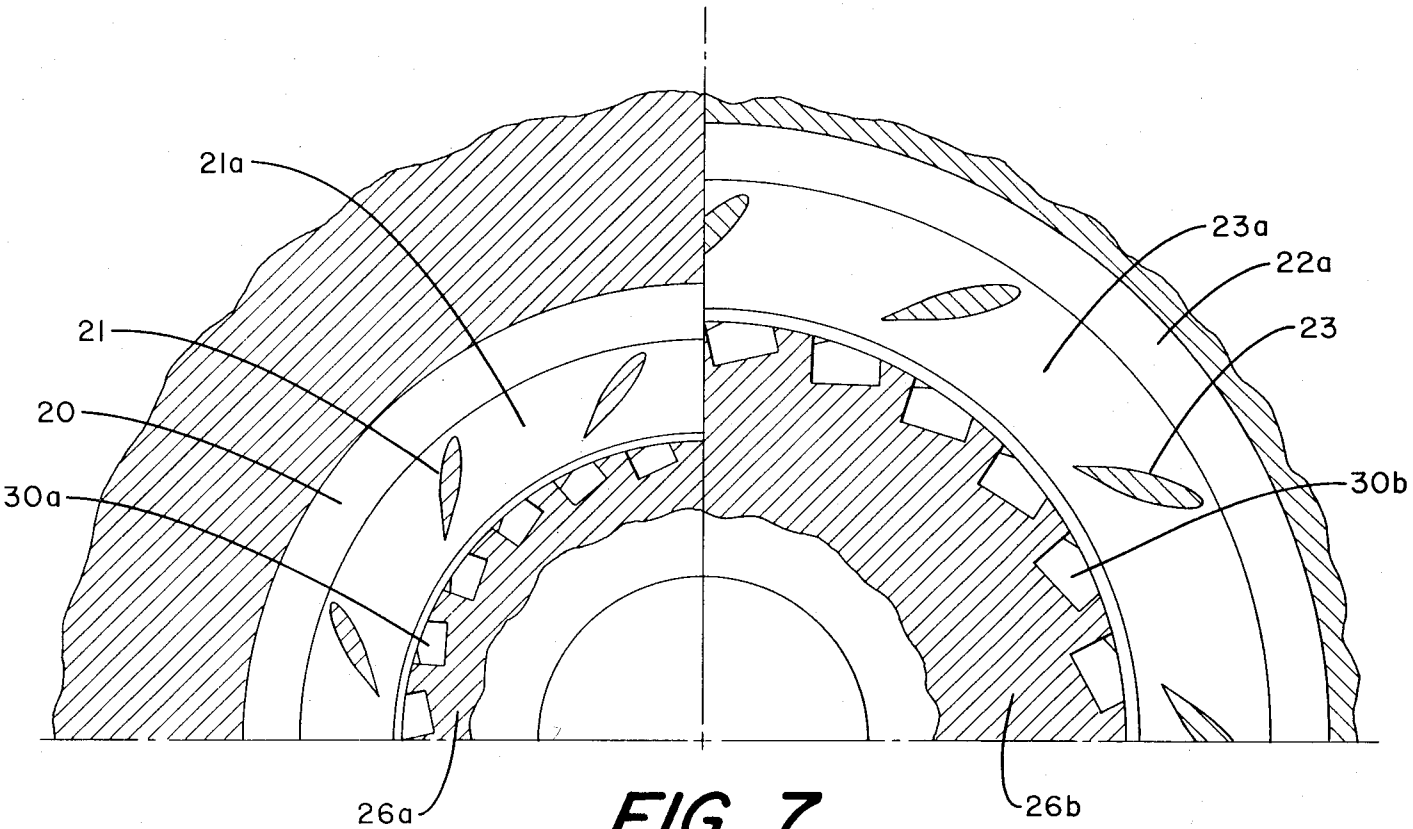
FIG. 7 is a partial sectional view of the nozzle arrangement in a 2-stage solid wheel turbine.

Referring now to FIGS. 1, 2 and 7, steam is axially supplied to the turbine 10 via inlet casing 12. The flow path of the steam through the turbine 10 from inlet casing 12 to the exhaust volute casing 16 is indicated by the arrows in FIG. 2. More specifically, steam serially passes around nose cone 13, through inlet guide vanes 14 and nozzles 21*a* defined by nozzle blades 21 to the first stage 26*a* of wheel or rotor 26. The steam passes through buckets 30*a* and then through vaneless diffuser 80, axial guide vanes 24 and nozzles 23*a* defined by nozzle blades 23 to the second stage 26*b* of wheel or rotor 26. The steam passes through buckets 30*b* and then passes through vaneless diffuser 81 into exhaust volute casing 16 and is exhausted from turbine 10 through side pipe discharge where the steam is either utilized in a process or condensed, etc. In passing through the buckets of each stage of the wheel or rotor 26, the steam is turned through 180° by the pressure surface or wall of the buckets and thereby imparts kinetic energy to the wheel or rotor 26 causing it to rotate together with shaft 28 and any power generating equipment connected thereto (not illustrated). This operation does not significantly differ from the basic operation of a conventional impulse turbine except that the through flow component is always radial whereas in a conventional axial machine it is always axial. However, as noted above, the bucket configuration of the present invention provides a number of operating advantages over conventional designs.

Figure 8:
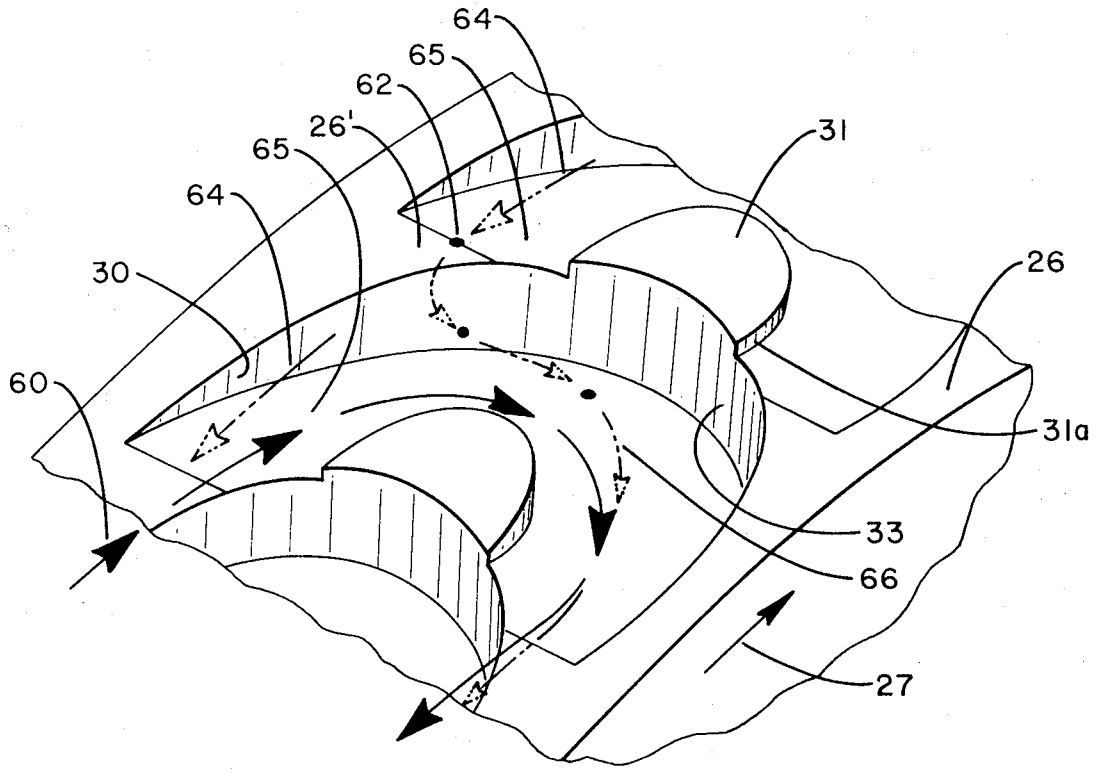
FIG. 8 is an isometric view of a bucket showing the fluid paths.

Additionally, the bucket configuration of the present invention provides considerable advantages when used with low quality/wet steam or dirty gas. Referring now to FIG. 8, steam indicated by the arrow 60 impinges upon the pressure surface or walls 33 of the buckets 30 imparting kinetic energy to the wheel 26 and causing it to rotate in the same direction in which the steam is supplied, as indicated by arrow 27. At operating speed, the wheel tip speed for each stage is about 30 to 65% that of the steam being supplied to that stage. With wet steam, the velocity of the water droplets present in the steam is less than that of the steam as well as that of the wheel 26, in most cases, so that the wheel 26 overtakes the water droplets 62 which have a negative velocity, in most cases, relative to that of the wheel 26. In a conventional bucket configuration, the downstream side of the buckets would overtake and impinge against the water droplets and be eroded thereby. However, when the buckets 30 are configured in accordance with the teachings of the present invention, the downstream portion of the conventional bucket does not exist and cannot be eroded. The relative velocity of the water droplets or particles 62 is indicated by arrows 64 and represents the water contained in the steam supplied by the nozzles. The exact relative velocity and direction would depend upon the steam design conditions. Because the machining of buckets 30 is as described above, a cusp shaped portion 26' of the original surface of the rim of the rotor or wheel 26 remains after machining. Because cusp 26' represents the outer surface of the rotor or wheel 26 and is a smooth transition from the bottom 65 of the bucket 30 to the outer surface of the rotor and is in line with the nozzles, the droplets or particles 62, when they impinge on the bottom 65 of the bucket 30 and/or cusp 26; would slide smoothly and fall into the next bucket and be entrained by the steam flow through that bucket as indicated by arrow 66. After passing through the bucket 30 the particles are ultimately ejected and dragged with the main steam flow in a vaneless diffuser. Since the water droplets or particles 62 impinge against the cusps 26' and the bucket bottom 65 at a very low angle of incidence, there is a very little, if any, erosion. Furthermore, even if erosion occurs in severe design conditions, it would take place at essentially infinite thickness (i.e. more or less towards the center of the rotor) so that mechanical failure which arises in conventional turbines due to breakage of the blades at the root is eliminated.

Although the present invention has been specifically described and illustrated in terms of a 2-stage steam turbine, other changes will occur to those skilled in the art. For example, the present invention is suitable for use in a single stage turbine and this single stage can be used as the control stage of an axial flow turbine requiring such a stage. The structure designated 36 can be a gear box and depending upon the design, the turbine can be an independent unit, such as is illustrated, or it can be integral with the gear box. Also, the rotor can be simply supported and, depending upon the RPM, the shaft can be stiff. Labyrinth seals 41 and 44 could be replaced with abraidible seals. It is therefore intended that the scope of the present invention is to be limited only by the scope of the appended claims.

What is claimed is:

1. In an impulse turbine having an inlet and an outlet with a flow path therebetween and with a nozzle ring and a turbine wheel forming a portion of the flow path, the improvement comprising:

said wheel having a first circumferential rim portion of a predetermined width with a plurality of uniformly spaced, overlapping buckets formed around said entire circumferential rim portion;

each of said buckets defining a generally U-shaped passage having two leg portions connected by a curved portion with said curved portion having a diameter less than said predetermined width and with said leg portions extending to said rim;

an island defining the inner segment of the curved portion of each bucket; and labyrinth sealing means circumferentially extending around said rim portion and coacting with said island of each bucket to provide a fluid seal between said leg portions which respectively define inlet and outlet fluid paths in said buckets.

2. The wheel of claim 1 further including:

a second circumferential rim portion of a predetermined width on said wheel with a plurality of uniformly spaced, overlapping buckets formed around said entire second circumferential rim portion;

each of said buckets in said second circumferential rim portion defining a generally U-shaped passage having two leg portions connected by a curved portion with said curved portion having a diameter less than said predetermined width and with said leg portions extending to said rim.

3. The wheel of claim 2 further including:

an island defining the inner segment of the curved portion of each bucket in said first and second portions;

first labyrinth sealing means circumferentially extending around said first rim portion and coacting with said islands in said first portion to provide a fluid seal between said leg portions of each of said buckets in said first portion which respectively define inlet and outlet fluid paths to said buckets in said first portion; and second labyrinth sealing means circumferentially extending around said second rim portion and coacting with said islands in said second portion to provide a fluid seal between said leg portions of each of said buckets in said second portion which respectively define inlet and outlet fluid paths to said buckets in said second portion.

* * * * *